US011289855B2

(12) United States Patent
Wada et al.

(10) Patent No.: US 11,289,855 B2
(45) Date of Patent: Mar. 29, 2022

(54) SHIELD CONNECTOR HAVING IMPROVED BONDING STRENGTH TO A SUBSTRATE

(71) Applicant: Yazaki Corporation, Tokyo (JP)

(72) Inventors: Yoshimi Wada, Shizuoka (JP); Takayuki Kobayashi, Shizuoka (JP); Isao Kameyama, Shizuoka (JP)

(73) Assignee: YAZAKI CORPORATION, Tokyo (JP)

( * ) Notice: Subject to any disclaimer, the term of this patent is extended or adjusted under 35 U.S.C. 154(b) by 0 days.

(21) Appl. No.: 17/004,542

(22) Filed: Aug. 27, 2020

(65) Prior Publication Data

US 2021/0066863 A1 Mar. 4, 2021

(30) Foreign Application Priority Data

Aug. 29, 2019 (JP) ..... JP2019-156445

(51) Int. Cl.

| | |
|---|---|
| ***H01R 13/6586*** | (2011.01) |
| ***H01R 13/6597*** | (2011.01) |
| ***H01R 13/6587*** | (2011.01) |
| ***H01R 12/70*** | (2011.01) |
| *H01R 12/72* | (2011.01) |

(52) U.S. Cl.

CPC ..... *H01R 13/6586* (2013.01); *H01R 12/707* (2013.01); *H01R 13/6587* (2013.01); *H01R 13/6597* (2013.01); *H01R 12/722* (2013.01)

(58) Field of Classification Search

CPC ..... H01R 13/6586; H01R 13/6597; H01R 12/722; H01R 43/0256; H01R 12/707; H01R 12/57; H01R 13/6588; H01R 13/6596; H01R 13/6594; H01R 13/6595; H01R 13/6587; H01R 12/716; H01R 13/502; H01R 13/648; H01R 13/73

See application file for complete search history.

(56) References Cited

U.S. PATENT DOCUMENTS

| | | | | |
|---|---|---|---|---|
| 3,179,912 A * | 4/1965 | Huber | ..... | H01R 24/50 439/581 |
| 5,562,496 A * | 10/1996 | Benjamin | ..... | H01R 12/707 439/607.36 |
| 5,897,384 A * | 4/1999 | Hosier, Sr. | ..... | H01R 24/50 439/63 |
| 6,079,986 A * | 6/2000 | Beshears | ..... | H01R 24/50 439/63 |

(Continued)

FOREIGN PATENT DOCUMENTS

| | | |
|---|---|---|
| JP | 4-130760 A | 5/1992 |
| JP | 2000-231945 A | 8/2000 |

(Continued)

*Primary Examiner* — Travis S Chambers

(74) *Attorney, Agent, or Firm* — Sughrue Mion, PLLC

(57) ABSTRACT

A shield connector includes a shield member for covering an outer periphery of a terminal, and a substrate mounting surface provided on the shield member and fixed to a surface of a substrate via solder, wherein the substrate mounting surface has a reference surface and a stepped surface having a different height with respect to the reference surface. For example, the stepped surface is formed by at least one of a convex portion protruding from the reference surface of the substrate mounting surface and a concave portion recessed from the reference surface of the substrate mounting surface.

16 Claims, 13 Drawing Sheets

(56) References Cited

U.S. PATENT DOCUMENTS

| | | | | |
|---|---|---|---|---|
| 6,623,283 | B1 * | 9/2003 | Torigian | H01R 43/0256 439/83 |
| 7,261,598 | B1 * | 8/2007 | Tseng | H01R 13/6582 439/607.36 |
| 7,416,418 | B2 * | 8/2008 | Berthet | H01R 24/50 439/66 |
| 10,103,485 | B2 * | 10/2018 | Ikeda | H01R 4/028 |
| 10,128,596 | B2 * | 11/2018 | Tsai | H01R 13/516 |
| 10,381,784 | B2 * | 8/2019 | Ju | H01R 24/60 |
| 10,879,654 | B2 * | 12/2020 | Gra l | H05K 1/0243 |
| 2013/0059472 | A1 | 3/2013 | Saito | |
| 2015/0083478 | A1 | 3/2015 | Endo et al. | |
| 2015/0155660 | A1 | 6/2015 | Lapidot et al. | |
| 2017/0302035 | A1 * | 10/2017 | Ju | H01R 13/6583 |

FOREIGN PATENT DOCUMENTS

| | | | |
|---|---|---|---|
| JP | 2013-058357 | A | 3/2013 |
| JP | 2013-125581 | A | 6/2013 |
| JP | 2015-60815 | A | 3/2015 |
| JP | 5788740 | B2 | 10/2015 |
| JP | 2016-201234 | A | 12/2016 |

* cited by examiner

SHIELD CONNECTOR HAVING IMPROVED BONDING STRENGTH TO A SUBSTRATE

CROSS-REFERENCE TO RELATED APPLICATIONS

The present application is based on, and claims priority from Japanese Patent Application No. 2019-156445, filed on Aug. 29, 2019, the entire contents of which are incorporated herein by reference.

TECHNICAL FIELD

The present application relates to a shield connector mounted on a substrate by solder.

BACKGROUND

The shield connector disclosed in JP 2013-58357 A includes a terminal, an inner housing, an inner shield member, an outer housing, and an outer shield member.

The shield connector disclosed in JP 2016-201234 A is a coaxial connector which includes a center terminal 130, an insulator housing 131 for holding the center terminal 130, and a shield member 132 as an outer conductor covering the outer periphery of the housing 131.

SUMMARY

However, the shield connector disclosed in JP 2013-58357 A has a configuration in which a first leg portion to a fourth leg portion are soldered while being inserted into through-holes.

Therefore, a solder crack may occur by an external force acting on the outer shield member, for example, and the bonding strength of the shield connector to a substrate is concerned.

The shield connector disclosed in JP 2016-201234 A has a configuration in which a plurality of leg portions is inserted into holes of a substrate and fixed.

Therefore, the shield member is likely to be displaced with respect to the substrate by an external force acting on the shield member, and the bonding strength of the shield connector to the substrate is concerned.

In order to improve the bonding strength to the substrate, solder bonding the entire substrate mounting surface is then considered. However, the bonding strength depends on the area of the substrate mounting surface.

Even when only a substrate mounting surface having a small area can be secured, there is a demand for securing sufficient bonding strength.

The present application has been made to solve the above problems, and an object of the present application is to provide a shield connector having improved bonding strength to a substrate.

A shield connector according to a first embodiment of the present application includes a shield member for covering an outer periphery of a terminal, and a substrate mounting surface provided on the shield member and fixed to a surface of a substrate via solder, wherein the substrate mounting surface has a reference surface and a stepped surface having a different height with respect to the reference surface.

The stepped surface is preferably formed by at least one of a convex portion protruding at a different height with respect to the reference surface of the substrate mounting surface and a concave portion recessed at a different height with respect to the reference surface of the substrate mounting surface.

The convex portion or the concave portion is preferably provided with an auxiliary convex portion protruding further than the convex portion or an auxiliary concave portion recessed further than the concave portion.

Preferably, the shield member has a wall portion protruding downward, a bottom surface of the wall portion includes the substrate mounting surface, and the reference surface is formed in a central region of the substrate mounting surface, and the stepped surfaces are formed in both end regions of the substrate mounting surface by the concave portions.

Preferably, the substrate mounting surface is provided with a positioning pin to be inserted into a positioning pin insertion hole of the substrate, and a periphery of the positioning pin is formed into the most concave surface of the reference surface and the stepped surface.

According to the above configuration, the reference surface, the stepped surface, and the stepped side surface formed by the step formed by these surfaces serve as bonded surfaces of solder, and thus the solder bonding area is increased as compared with the case where the substrate mounting surface is a flat surface. Therefore, a shield connector can be provided which improves the bonding strength of the shield connector to the substrate.

DETAILED DESCRIPTION

Figure 1:
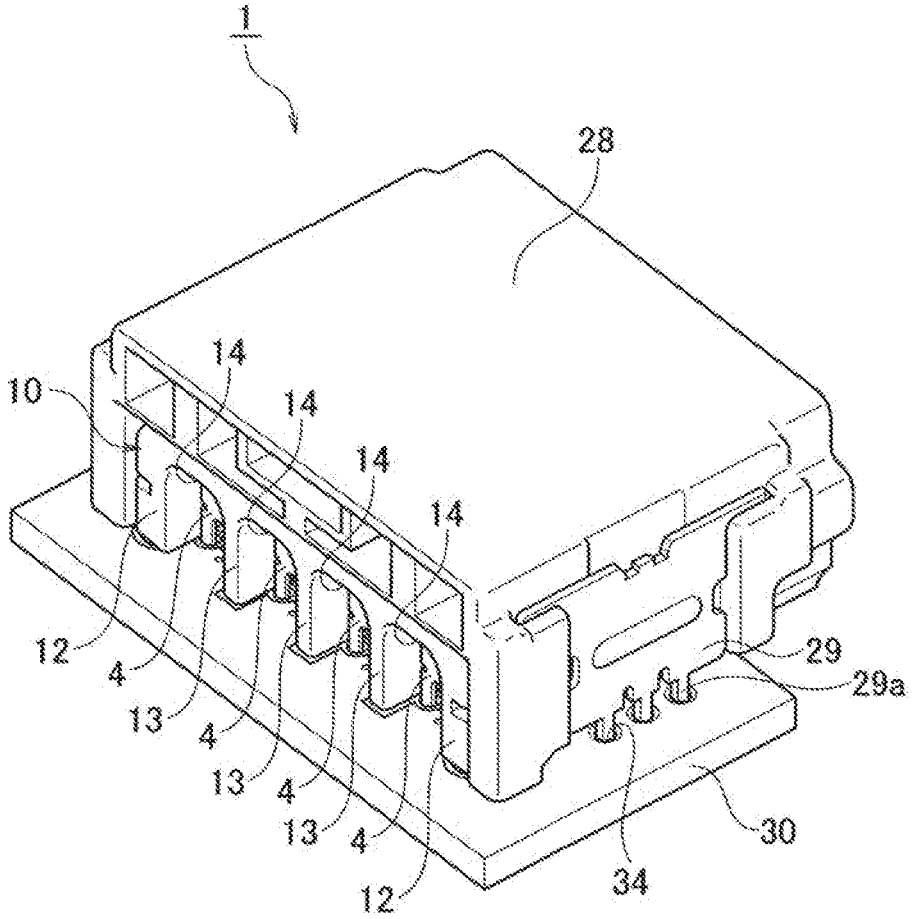
FIG. 1 is a perspective view of a shield connector mounted on a substrate according to a first embodiment.

Hereinafter, a shield connector according to the present embodiment will be described in detail with reference to the drawings. Note that the dimension ratio of the drawing is exaggerated for convenience of explanation, and may differ from the actual ratio.

Figure 2:
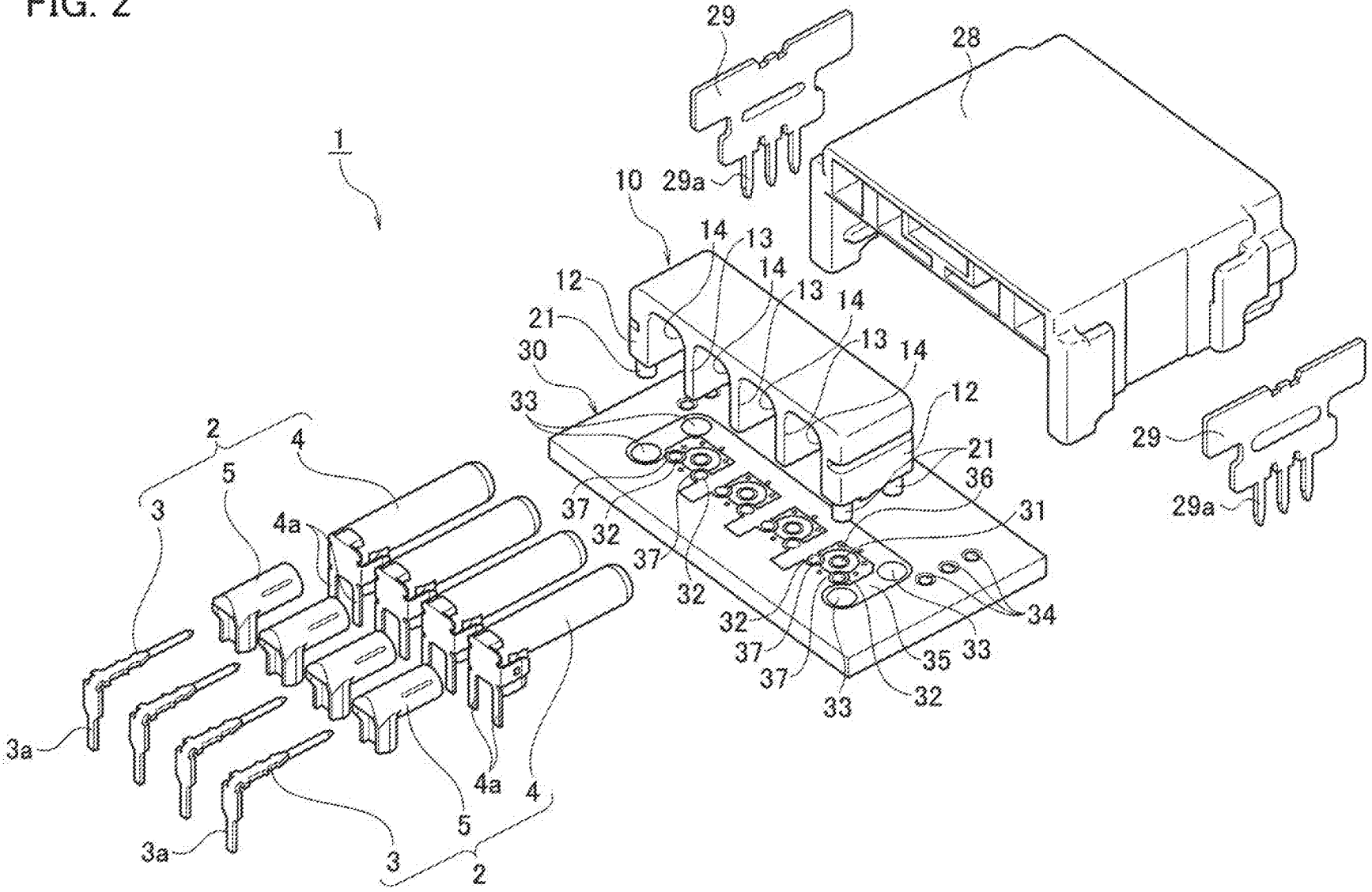
FIG. 2 is an exploded perspective view of the shield connector.

A shield connector 1 according to a first embodiment is illustrated in FIGS. 1 to 7C. As illustrated in FIGS. 1 and 2, the shield connector 1 is a high frequency connector used for communication. The shield connector 1 includes four terminal assemblies 2, a shield member 10 formed of a conductive material, and a housing 28 formed of an electrical insulating material. In FIG. 2, the direction in which each terminal assembly 2 is housed in each terminal housing chamber 14 is a terminal housing direction, the longitudinal direction of the shield member 10 orthogonal to the terminal housing direction and parallel to the arrangement direction of each terminal housing chamber 14 is a width direction, and the direction which is orthogonal to the terminal housing direction and the width direction and in which a positioning pin 21 is inserted into a positioning pin insertion hole 33 of a substrate 30 is a height direction. Note that the directions such as "anterior and posterior" and "upper and lower" are determined for convenience of explanation, and do not limit the actual mounting posture of each element.

Each terminal assembly 2 includes an inner terminal 3, an outer terminal 4, and an inner housing 5 for holding the inner terminal 3 and the outer terminal 4. The inner terminal 3 and the outer terminal 4 have substrate connection pins 3*a* and 4*a*, respectively.

The shield member 10 is made of die casting formed by die casting. The shield member 10 has an upper surface wall 11, and five wall portions 12, 13 which are spaced at intervals and protrude downward (one side in the height direction in FIG. 2) from the upper surface wall 11. Four terminal housing chambers 14 are formed by two wall portions 12 and 13 adjacent to the upper surface wall 11. Each terminal assembly 2 is housed in each terminal housing chamber 14. Thus, the shield member 10 covers the outer peripheries of the inner terminal 3 and the outer terminal 4.

Note that the shield member 10 and the outer terminal 4 are in contact with each other and electrically connected to each other.

The bottom surfaces of the wall portions 12 and 13 on one side in the height direction in FIG. 2 are formed on the substrate mounting surfaces 20 and 26 fixed to the surface of the substrate 30 via solder 41, respectively.

Figure 3:
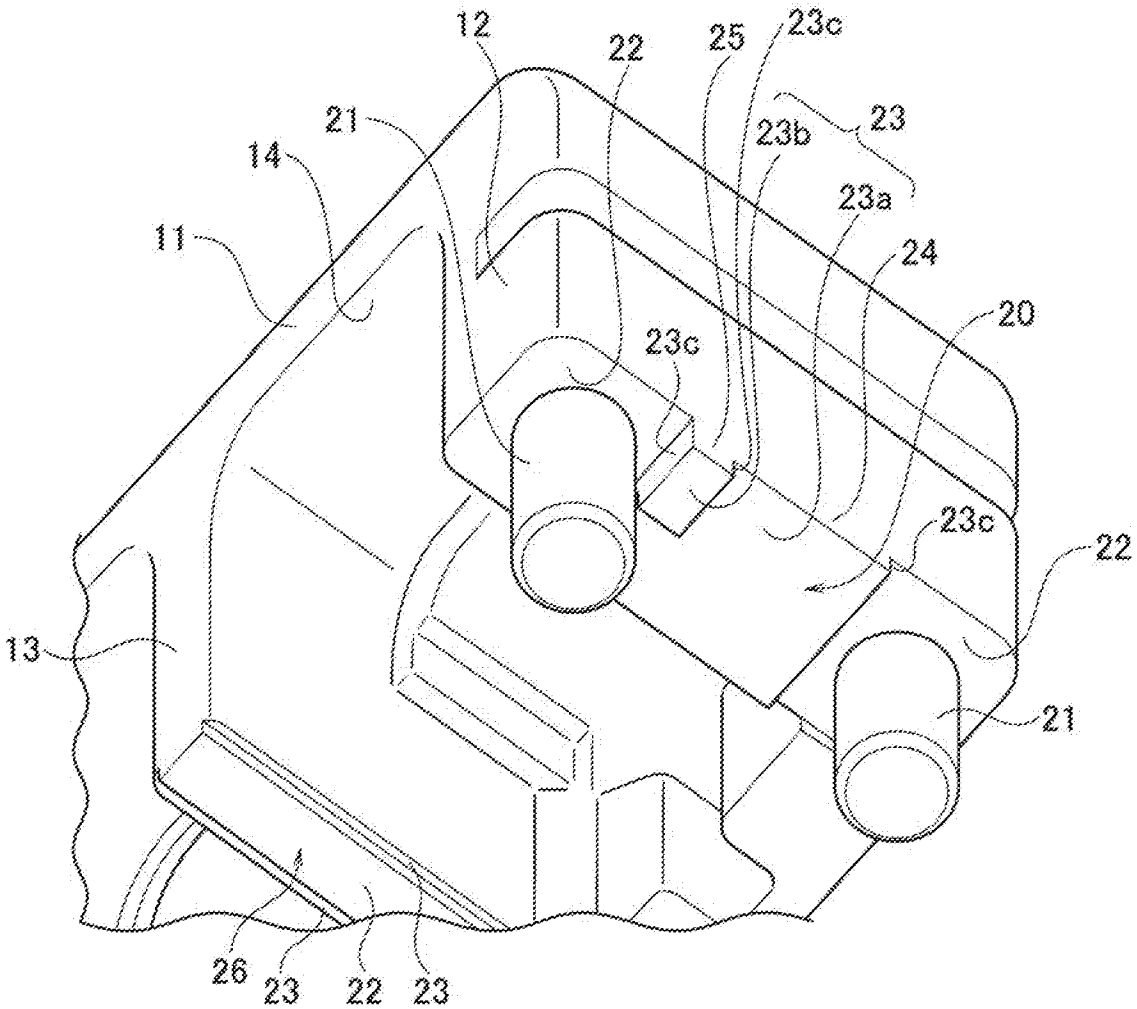
FIG. 3 is a perspective view of a main portion of a shield member, viewed from the bottom surface side.
Figure 4A:
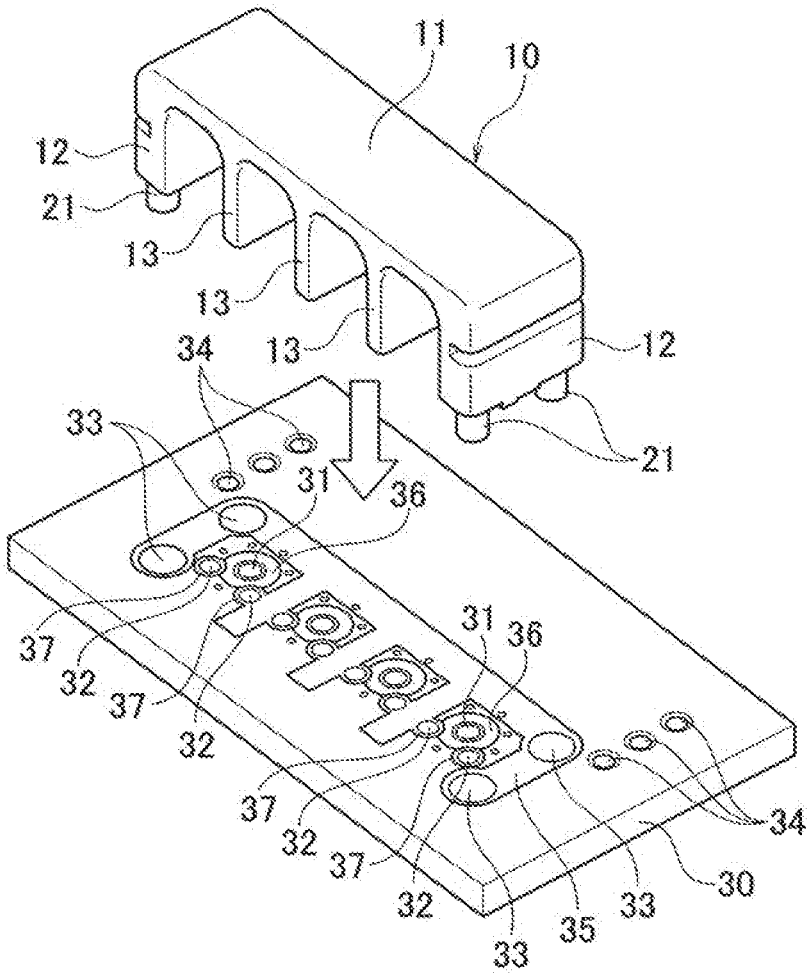
FIG. 4A is a perspective view illustrating a state before the shield member is arranged on the substrate.
Figure 5A:
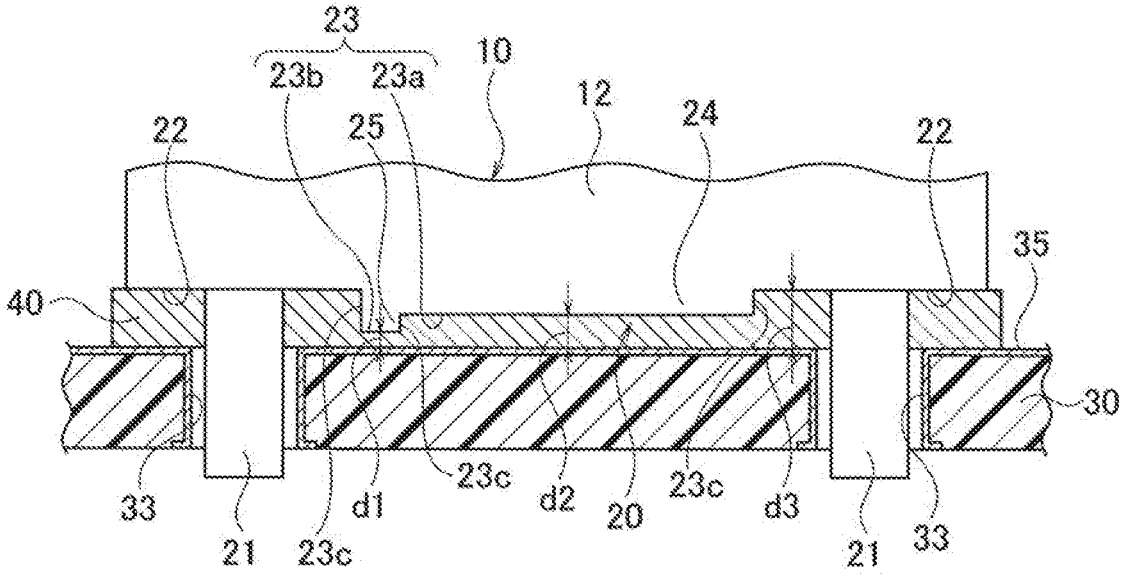
FIG. 5A is a cross-sectional view taken along line VI-VI of FIG. 4B.
Figure 5B:
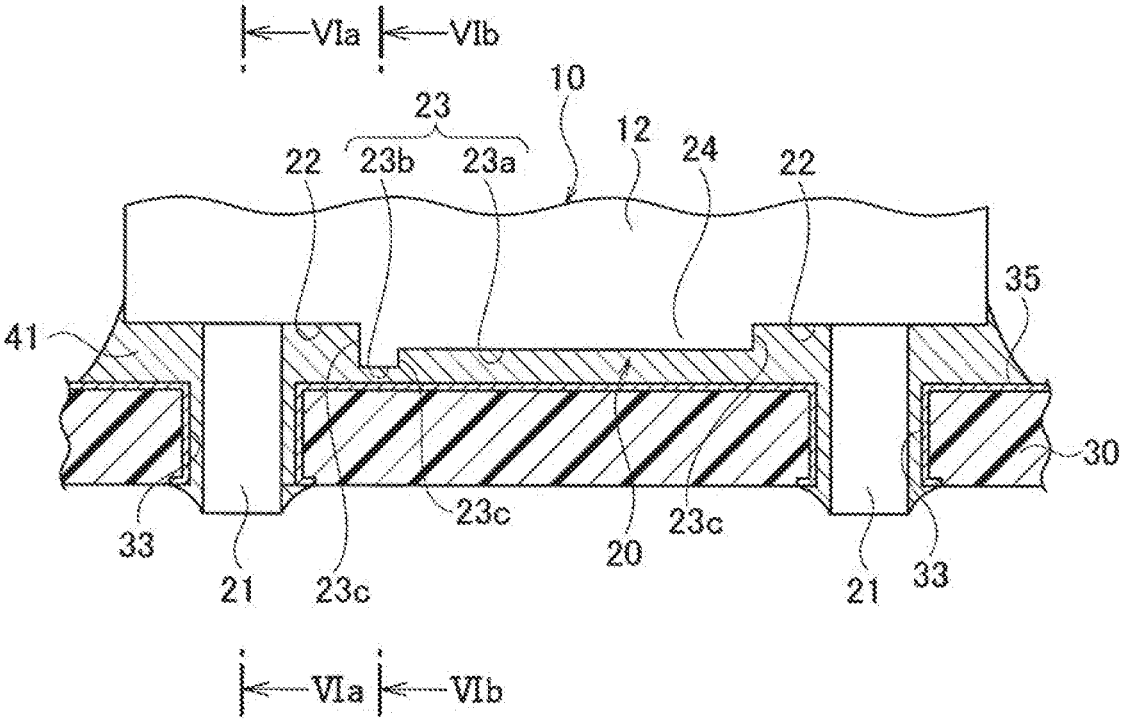
FIG. 5B is a cross-sectional view illustrating the soldered state of FIG. 4A.

As illustrated in FIGS. 3, 5A, and 5B, two positioning pins 21 are respectively provided on the substrate mounting surface 20 of each wall portion 12 positioned at both ends (both ends in the width direction in FIG. 2) of the shield member 10. As illustrated in FIG. 4A, inserting the positioning pins 21 of the shield member 10 into the positioning pin insertion holes 33 of the substrate 30 described below allows the shield member 10 to be arranged on the substrate 30.

Figure 4B:
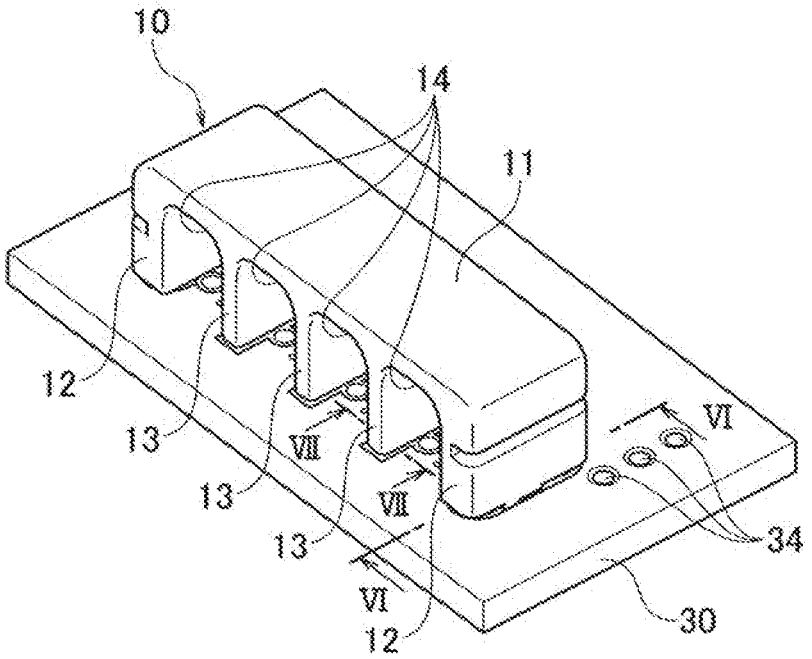
FIG. 4B is a perspective view illustrating a state in which the shield member is arranged on the substrate.

Note that although the shield member 10 is arranged on the substrate 30 in a state where the four terminal assemblies 2 and the housing 28 are assembled as described in the manufacturing procedure of the shield connector 1 below, only a state where the shield member 10 is arranged on the substrate 30 is illustrated in FIG. 4B.

As illustrated in FIG. 5A, the substrate mounting surfaces 20 of the wall portions 12 located at both ends of the shield member 10 have a reference surface 22 and a stepped surface 23 having a different height (one side in the height direction and in the downward direction in FIG. 5A) with respect to the reference surface 22. The reference surface 22 is formed around each positioning pin 21, and other surfaces are formed on the stepped surface 23. The stepped surface 23 is formed by a convex portion 24 protruding in the downward direction in FIG. 5A, which is one side in the height direction from the reference surface 22 of the substrate mounting surface 20, and an auxiliary convex portion 25 protruding in the downward direction in FIG. 5A, which is one side in the height direction further from the convex portion 24.

In other words, the substrate mounting surfaces 20 of the two wall portions 12 located at both ends of the shield member 10 are composed of the reference surface 22 which is the most concave (low) with respect to the downward direction in FIG. 5A which is one side in the height direction, a first stepped surface 23*a* having an intermediate height formed by the convex portion 24, and a second stepped surface 23*b* which is the most protruding (high) with respect to the downward direction in FIG. 5A which is one side in the height direction formed by the auxiliary convex portions 25.

Therefore, as illustrated in FIG. 5A, when the shield member 10 is arranged on the substrate 30 coated with a solder paste 40, a gap d1 is formed between the second stepped surface 23*b* and the substrate 30, a gap d2 is formed between the first stepped surface 23*a* and the substrate 30, and a gap d3 is formed between the reference surface 22 and the substrate 30. Thus, the gap d3 is the largest dimension, the gap d2 is the next largest dimension, and the gap d1 is the smallest dimension.

As illustrated in FIGS. 3 and 7A to 7C, the substrate mounting surfaces 26 of the three wall portions 13 at the intermediate position in the width direction of the shield member 10 in FIG. 2 have the reference surface 22 and the stepped surface 23 having a different height with respect to the reference surface 22. The reference surface 22 is a central region in the width direction of the substrate mounting surface 26 in FIG. 2, and both end regions in the width direction of the substrate mounting surface 26 in FIG. 2 are formed on the stepped surfaces 23. The stepped surface 23 is formed by a concave portion 27 recessed from the reference surface 22.

As illustrated in FIG. 1, the housing 28 is arranged to further cover the shield member 10. The housing 28 has a mating connector fitting chamber (not illustrated). When a mating connector (not illustrated) is fitted into the mating connector fitting chamber (not illustrated), the inner terminal 3 and a mating inner terminal (not illustrated) are electrically connected to each other, and the outer terminal 4 and a mating outer terminal (not illustrated) are electrically connected to each other.

Pegs 29 are fixed to both sides of the housing 28 in the width direction in FIG. 2. The housing 28 is soldered to the substrate 30 by peg pins 29*a* of a pair of pegs 29.

The substrate 30 is provided with an inner pin insertion hole 31, an outer pin insertion hole 32, a positioning pin insertion hole 33, and a peg pin insertion hole 34. On an upper surface (the other side in the height direction in FIG. 2) which is a component mounting surface of the substrate 30, a conductive pad 35 is provided at a shield mounting position having a positioning pin insertion hole 33. Conductive pads 36 and 37 are respectively provided around the inner pin insertion hole 31 and the outer pin insertion hole 32. The conductive pad 35 at the shield mounting position and the conductive pad 37 around the outer pin insertion hole 32 are connected to the ground circuit of the substrate 30.

A manufacturing procedure of the shield connector 1 will be briefly described below. The solder paste 40 (see FIG. 5A) is assumed to be applied on the conductive pads 35, 36, 37, for example. The solder paste 40 is not illustrated in FIGS. 2 and 3.

First, the shield member 10 and the peg 29 are assembled to the housing 28.

The four terminal assemblies 2 are then assembled in the respective terminal housing chambers 14 of the shield member 10. Thus, the shield connector 1 is assembled.

The shield connector 1 is then arranged on the substrate 30. Specifically, the peg pins 29*a* of the pegs 29 are inserted into the peg pin insertion holes 34, and the housing is arranged on the substrate 30. The substrate connection pin 3*a* of each terminal assembly 2 is inserted into the inner pin insertion hole 31 and the substrate connection pin 4*a* is inserted into the outer pin insertion hole 32, and each terminal assembly 2 is arranged on the substrate 30. The positioning pin 21 of the shield member 10 is inserted into the positioning pin insertion hole 33 of the substrate 30, and the shield member 10 is arranged on the substrate 30.

Figure 7A:
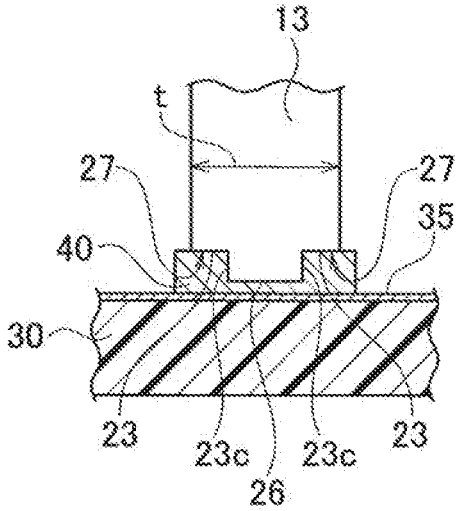
FIG. 7A is a cross-sectional view taken along line VII-VII of FIG. 4B; p

When the shield member 10 is arranged on the substrate 30, the solder paste 40 is arranged between the substrate mounting surfaces 20 and 26 and the substrate 30 without a gap (see FIGS. 5A and 7A).

A solder reflow process is then performed. In the solder reflow process, the solder paste 40 is melted. The molten solder 41 solidifies as the temperature drops. Thus, the inner terminal 3, the outer terminal 4, and the peg pin 29*a* are soldered to the substrate 30. The shield member 10 and the positioning pin 21 are also soldered to the substrate 30.

The structure of soldering the shield member 10 and the positioning pin 21 to the substrate 30 will then be described. As illustrated in FIG. 5A, the substrate mounting surface 20 of the wall portion 12 located at both ends of the shield member 10 has the reference surface 22, the first stepped surface 23*a*, and the second stepped surface 23*b* which have different heights.

Figure 6A:
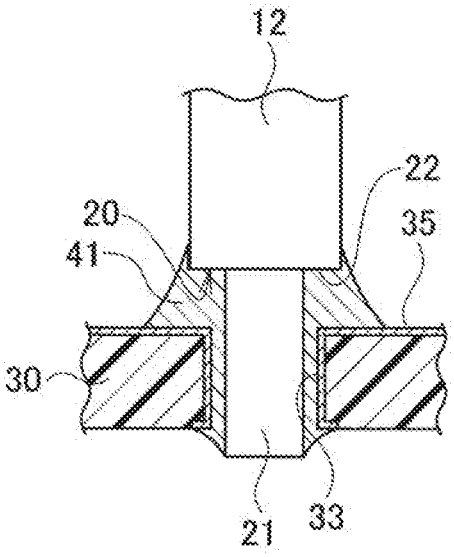
FIG. 6A is a cross-sectional view taken along line VIa-VIa of FIG. 5B.
Figure 6B:
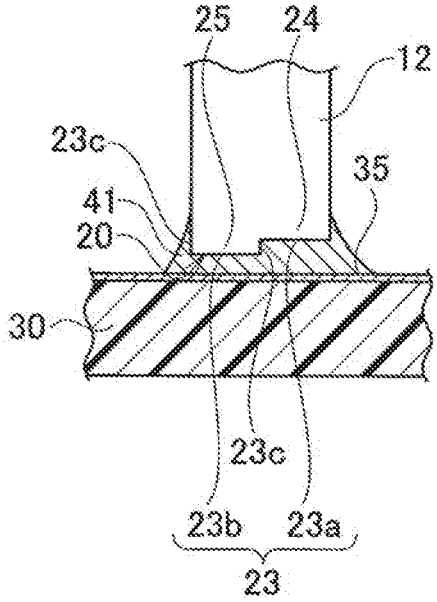
FIG. 6B is a cross-sectional view taken along line VIb-VIb of FIG. 5B.

As illustrated in FIGS. 5B, 6A, and 6B, the reference surface 22, the first stepped surface 23*a*, the second stepped surface 23*b*, and each stepped side surface 23*c* formed by the step formed by these surfaces serve as bonded surfaces of the solder 41 for soldering.

As illustrated in FIG. 7A, the substrate mounting surface 26 of the wall portion 13 at the intermediate position of the shield member 10 has the reference surface 22 and the stepped surface 23 which have different heights. Therefore, as illustrated in FIG. 6B, the reference surface 22, the stepped surface 23, and each stepped side surface 23*c* formed by the step formed by these surfaces serve as bonded surfaces of the solder 41 for soldering.

As described above, the shield connector 1 includes the shield member 10 for covering the outer peripheries of the inner terminal 3 and the outer terminal 4, and the substrate mounting surfaces 20 and 26 provided on the shield member 10 and fixed to the surface of the substrate 30 via the solder 41. The substrate mounting surfaces 20 and 26 have the reference surface 22 and the stepped surface 23 (23*a*, 23*b*) having a different height with respect to the reference surface 22.

Therefore, as described above, the reference surface 22, the stepped surface 23 (23*a*, 23*b*), and the stepped side surface 23*c* formed by the step formed by these surfaces serve as bonded surfaces of the solder 41 for soldering. Thus, the solder bonding area is increased as compared with the case where the substrate mounting surfaces 20 and 26 are flat surfaces, so that the bonding strength of the shield connector 1 to the substrate 30 is improved.

In other words, even when only a small substrate mounting surface can be secured, the bonding strength of the shield member 10 to the substrate 30 can be secured.

On the substrate mounting surface 20 of the wall portions 12 located at both ends, the stepped surface 23 (23*a*, 23*b*) is formed by the convex portion 24 and the auxiliary convex portion 25 protruding from the reference surface 22 of the substrate mounting surface 20. Therefore, the stepped surface 23 (23*a*, 23*b*) can be formed only by providing the convex portions 24 and the auxiliary convex portions 25 on the substrate mounting surface 20, so that the structure is simple and easy to manufacture.

On the substrate mounting surface 26 of the wall portion 13 at the intermediate position of the shield member 10, the stepped surface 23 is formed by the concave portion 27 recessed from the reference surface 22 of the substrate mounting surface 26.

Therefore, the stepped surface 23 can be formed only by providing the concave portion 27 on the substrate mounting surface 26, so that the structure is simple and easy to manufacture.

On the substrate mounting surface 26 of the wall portion 13 at the intermediate position of the shield member 10, the central region of the substrate mounting surface 26 is formed into the reference surface 22, and both end regions of the substrate mounting surface 26 are formed into the stepped surface 23 by the concave portion 27.

Figure 7B:
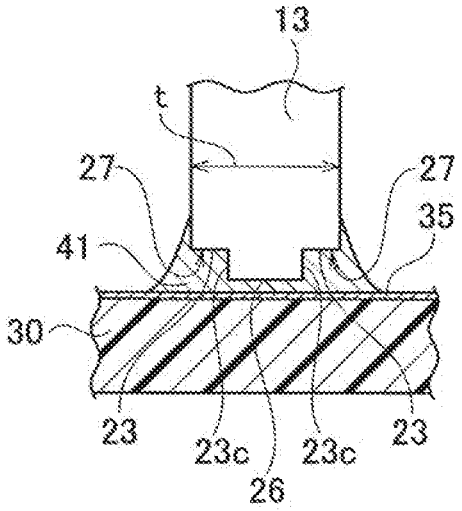
FIG. 7B is a cross-sectional view taken along line VII-VII of FIG. 4B in the case of soldering with a large amount of solder.

Therefore, if the amount of solder 41 interposed between the substrate mounting surface 26 and the substrate 30 is large, as illustrated in FIG. 7B, the solder 41 is interposed between the reference surface 22, the stepped surface 23, and the stepped side surface 23*c* formed by the reference surface 22 and the stepped surface 23, and a solder fillet is formed on both side surfaces of the wall portion 13. Thus, since both side surfaces of the wall portion 13 are also used as the bonded surfaces of the solder 41, the solder bonding area is further increased, so that the bonding strength of the shield connector 1 to the substrate 30 is further improved.

Figure 7C:
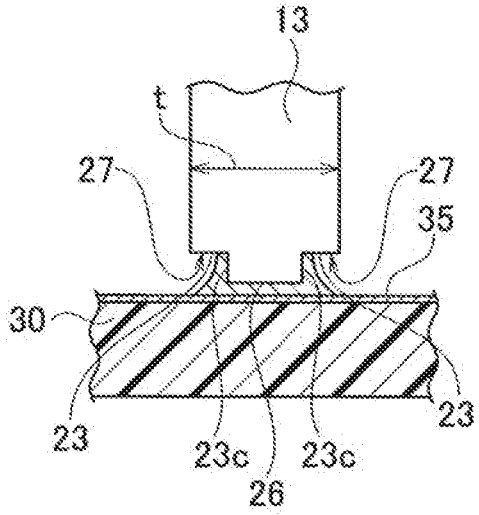
FIG. 7C is a cross-sectional view taken along line VII-VII of FIG. 4B in the case of soldering with a small amount of solder.

If the amount of solder 41 interposed between the substrate mounting surface 26 and the substrate 30 is small, as illustrated in FIG. 7C, the solder 41 may be bonded only to the reference surface 22. In this case, a solder fillet is formed by the stepped side surface 23*c* formed by the step between the reference surface 22 and the stepped surface 23, and an appropriate solder bonding configuration can be secured. Therefore, the bonding strength of the shield connector 1 to the substrate 30 can be increased even with a small solder bonding area.

In other words, forming the substrate mounting surface 26 of the wall portion 13 in this manner enables to secure an appropriate solder bonding configuration even if the thickness t (illustrated in FIGS. 7A to 7C) of the wall portion 13 is reduced, so that the pitch of the terminal housing chamber 14 can be narrowed. Therefore, the shield connector 1 can be miniaturized.

The positioning pins 21 inserted into the positioning pin insertion holes 33 of the substrate 30 are provided on the substrate mounting surfaces 20 of the wall portions 12 at both end positions of the shield member 10. The periphery of the positioning pin 21 is formed into the most concave surface (in this embodiment, the reference surface 22) of the reference surface 22, the first stepped surface 23*a*, and the second stepped surface 23*b*.

Therefore, as illustrated in FIG. 5B, the gap d3 is formed between the reference surface 22 around the positioning pin 21 and the substrate 30 so that the solder 41 is reliably interposed between the reference surface 22 and the substrate 30, and thus the periphery of the positioning pin 21 is reliably soldered. Since the periphery of the positioning pin 21 is reliably soldered and the bonding strength around the positioning pin 21 is reliably increased, the bonding strength of the shield connector 1 to the substrate 30 is improved.

Figure 8:
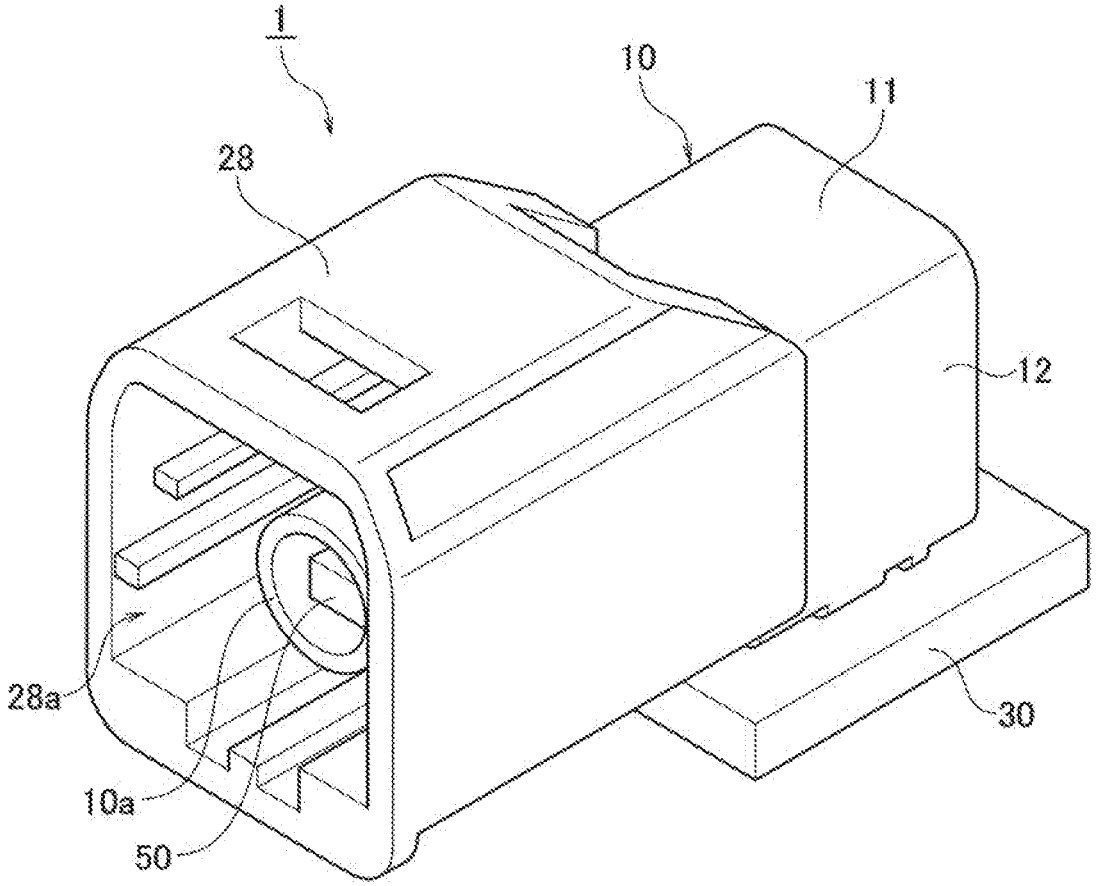
FIG. 8 is a perspective view of a shield connector mounted on a substrate according to a second embodiment.

The shield connector 1 according to a second embodiment is illustrated in FIGS. 8 to 11B. The shield connector 1 is a high frequency connector used for communication. As illustrated in FIG. 8, the shield connector 1 includes an inner housing 5A for holding an inner terminal 50, and a shield member 10 arranged on the outer periphery of the inner housing 5A. Further, the shield connector 1 includes a housing 28 arranged on the outer periphery of the shield member 10.

A mating connector fitting chamber 28*a* is formed in the housing 28. The inner terminal 50 is arranged in the mating connector fitting chamber 28*a*. The inner terminal 50 is housed in a cylindrical portion 10*a* of the shield member. 10 in the mating connector fitting chamber 28*a*. A mating connector (not illustrated) is fitted into the mating connector fitting chamber 28*a*.

The shield member 10 covers the outer periphery of the inner terminal 50 by being arranged on the outer periphery of the inner housing 5A. The shield member 10 has an upper surface wall 11 and three wall portions 12 suspended from the upper surface wall 11. A housing space 55 is formed by being surrounded by the upper surface wall 11 and the three wall portions 12. The inner housing 5A is housed in the housing space 55. A substrate connection pin 50*a* of the inner terminal 50 protrudes from the bottom surface side of the inner housing 5A. The substrate connection pin 50*a* is soldered to the substrate 30.

Figure 9:
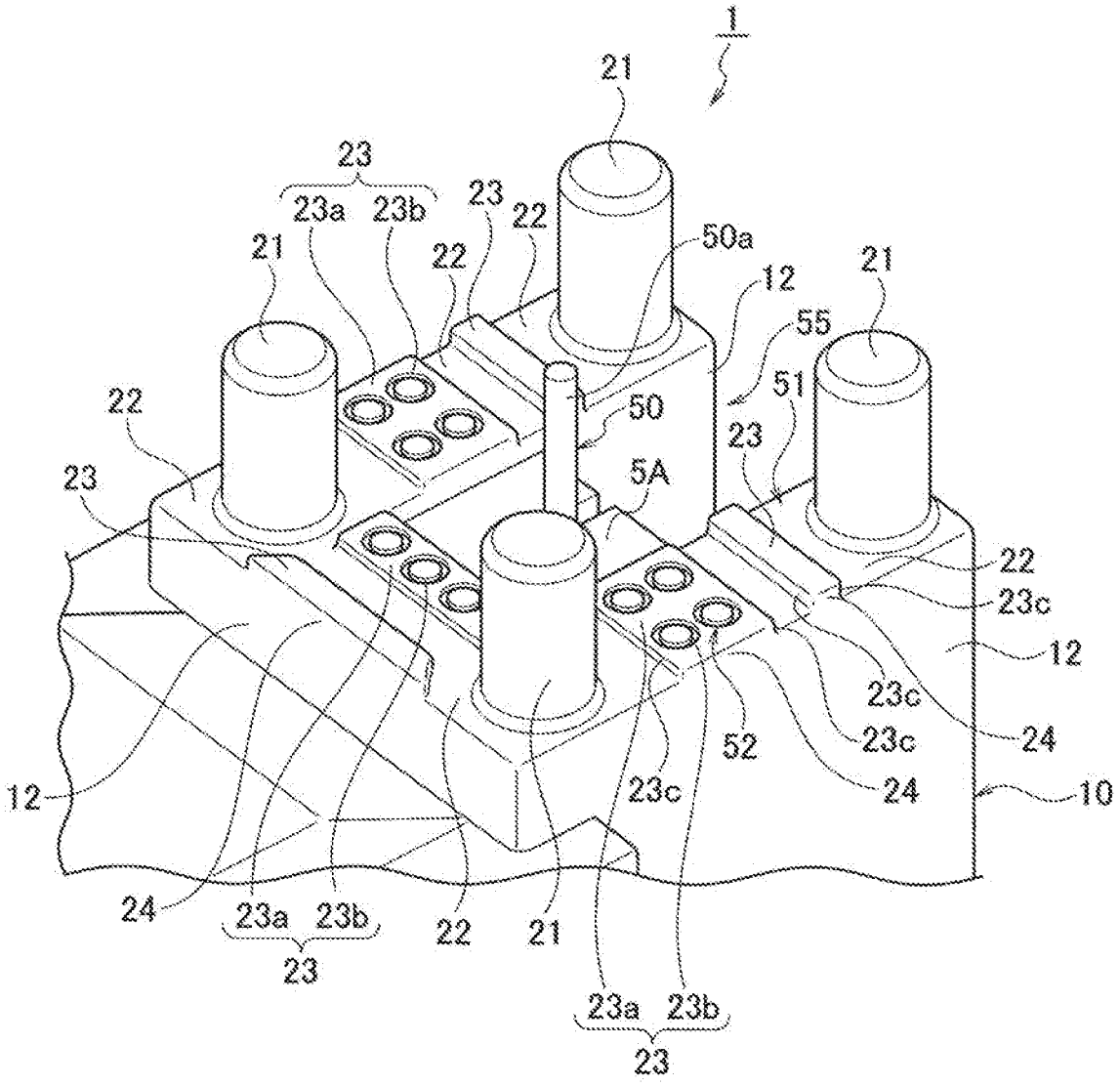
FIG. 9 is a perspective view of a main portion of a shield member according to the second embodiment, viewed from the bottom surface side.
Figure 10A:
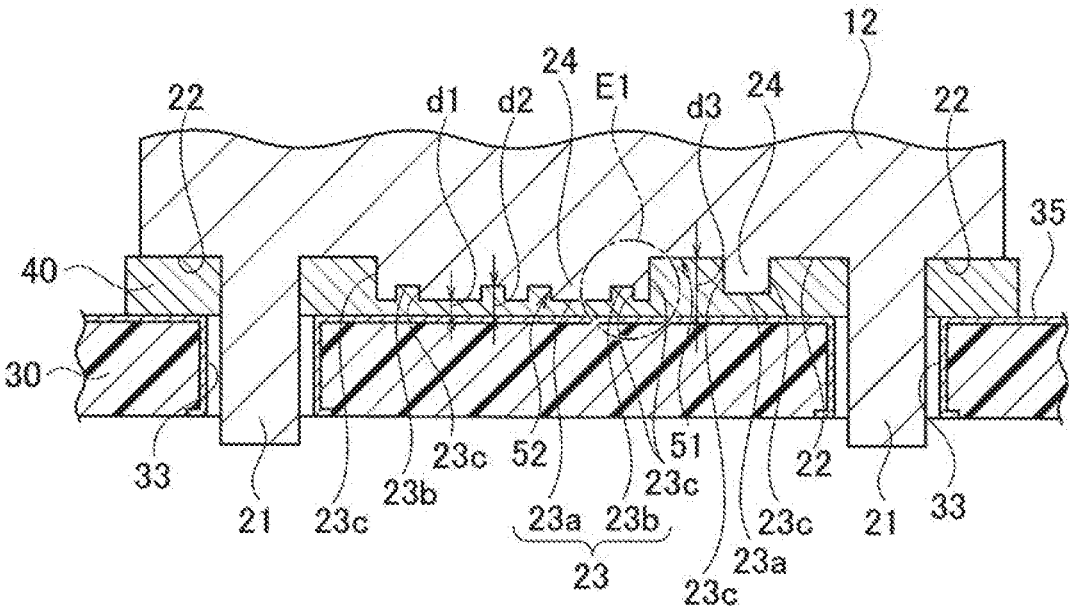
FIG. 10A is a cross-sectional view of a main portion illustrating a state in which the shield member according to the second embodiment is arranged on the substrate.
Figure 10B:
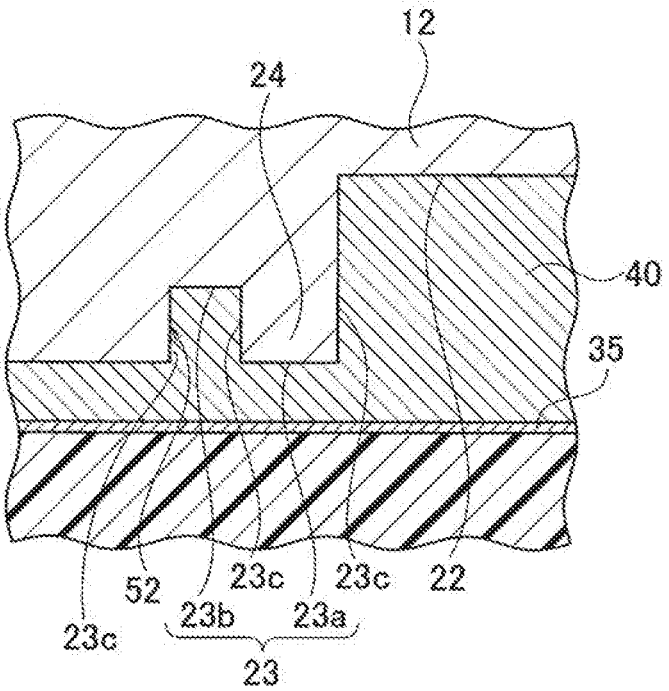
FIG. 10B is an enlarged view of an E1 portion of FIG. 10A.

As illustrated in FIG. 9, the bottom surface of each wall portion 12 of the shield member 10 is formed on a substrate mounting surface 51. Positioning pins 21 are respectively provided at four corner positions of the substrate mounting surface 51.

As illustrated in FIGS. 9 to 11B, the substrate mounting surface 51 has a reference surface 22 and a stepped surface 23 having a different height with respect to the reference surface 22. The reference surface 22 is formed around each positioning pin 21, and other surfaces are formed on the stepped surface 23.

A part of the stepped surface 23 is formed by a convex portion 24 protruding from the reference surface 22 of the substrate mounting surface 51. The other part of the stepped surface 23 is formed by the convex portion 24 and an auxiliary concave portion 52 provided in the convex portion 24. The auxiliary concave portion 52 is a circular groove.

In other words, the substrate mounting surface 51 is composed of the reference surface 22 which is the most concave (low), a first stepped surface 23*a* which is formed by the convex portion 24 and is the most protruding (high), and a second stepped surface 23*b* which is formed by the auxiliary concave portion 52 and has an intermediate height.

Figure 11A:
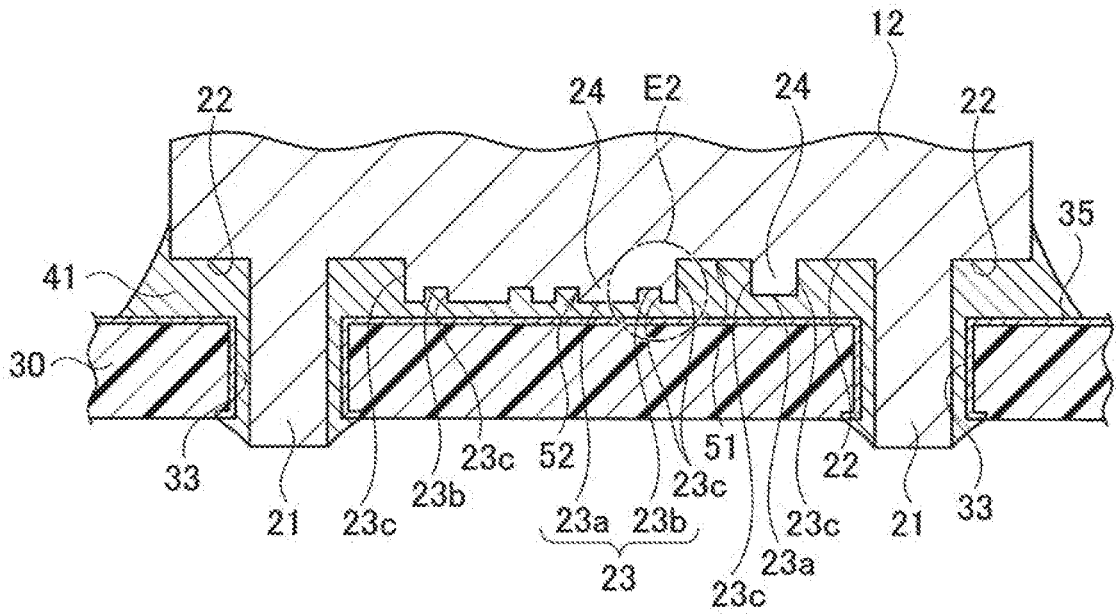
FIG. 11A is a cross-sectional view illustrating the soldered state of FIG. 10A according to the second embodiment.
Figure 11B:
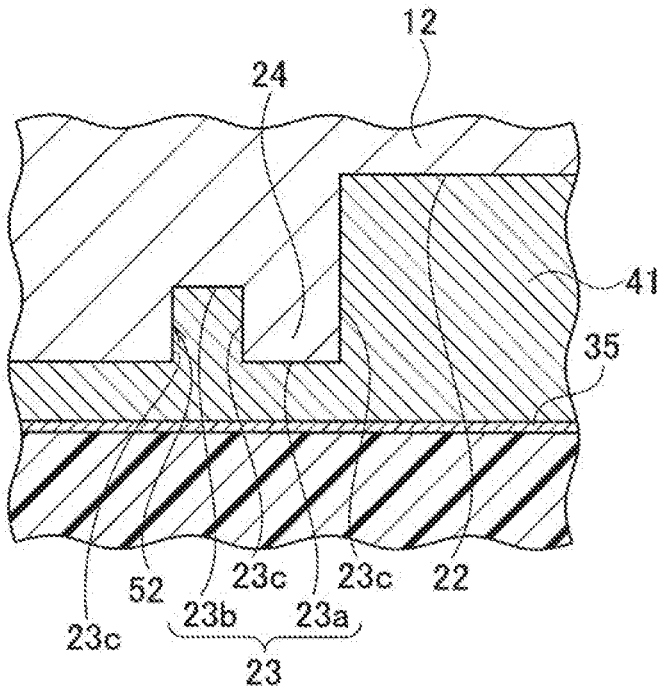
FIG. 11B is an enlarged view of an E2 portion of FIG. 11A.

The substrate mounting surface 51 is soldered to the substrate 30 by a solder reflow process in the same manner as in the first embodiment. In the solder reflow process, the molten solder 41 also enters into the auxiliary concave portion 52 (see FIG. 11B). Therefore, as in the first embodiment, as illustrated in FIGS. 11A and 11B, the reference surface 22, the first stepped surface 23*a*, the second stepped surface 23*b*, and each stepped side surface 23*c* formed by the step formed by these surfaces serve as bonded surfaces of the solder 41 for soldering.

As described above, the shield connector 1 includes the shield member 10 for covering the outer periphery of a terminal (not illustrated), and the substrate mounting surface 51 provided on the shield member 10 and fixed to the surface of the substrate 30 via the solder 41. The substrate mounting surface 51 has the reference surface 22 and the stepped surface 23 (first stepped surface 23*a* and second stepped surface 23*b*) having a different height with respect to the reference surface 22.

Therefore, as in the first embodiment, the reference surface 22, the stepped surface 23 (first stepped surface 23*a* and second stepped surface 23*b*), and the stepped side surface 23*c* formed by the step formed by these surfaces serve as bonded surfaces of the solder 41 for soldering.

Thus, the solder bonding area is increased as compared with the case where the substrate mounting surface 51 is a flat surface, so that the bonding strength of the shield connector 1 to the substrate 30 is improved.

Figure 12:
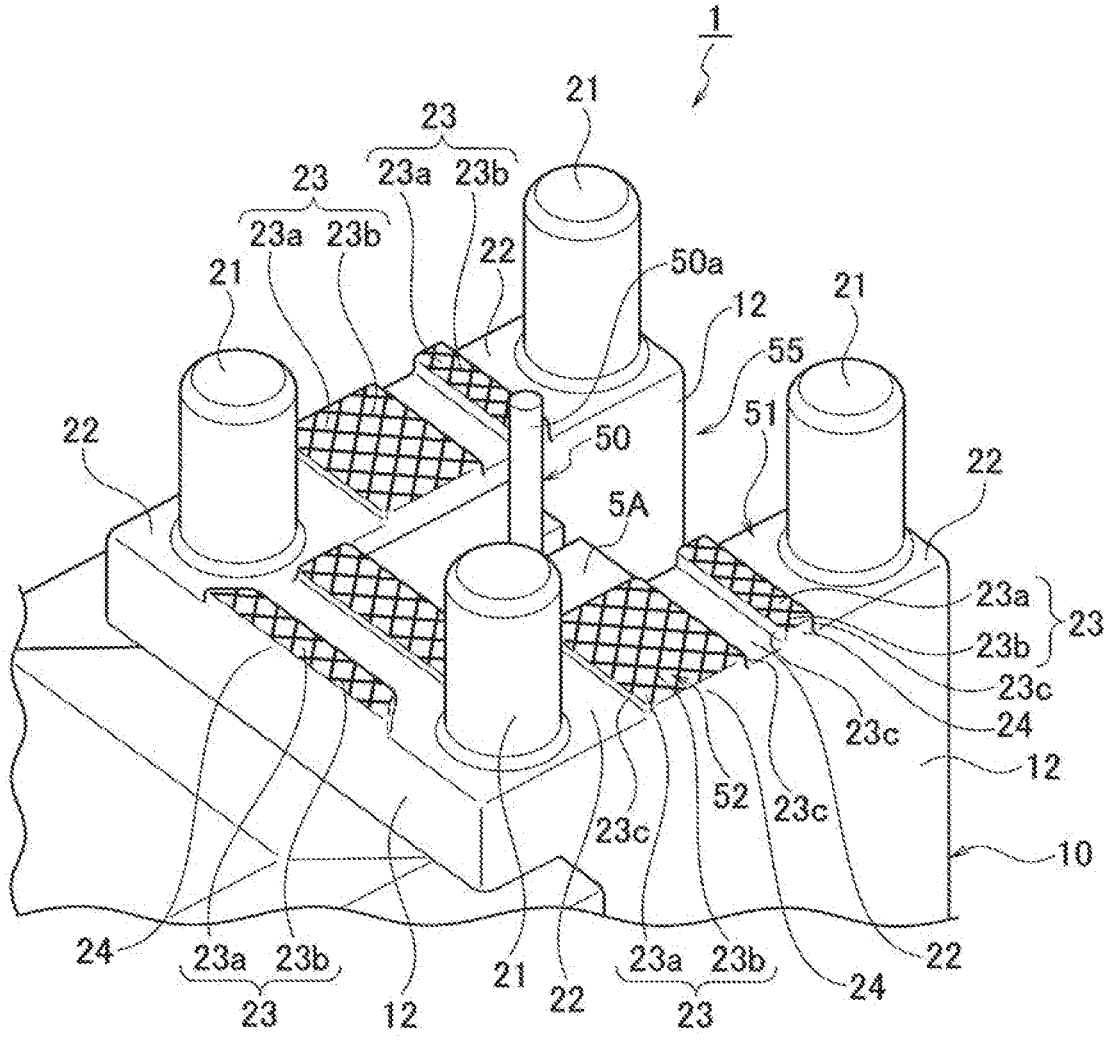
FIG. 12 is a perspective view of a main portion of a shield member according to a first modified example of the second embodiment, viewed from the bottom surface side.

The shield connector 1 according to a first modified example of the second embodiment is illustrated in FIG. 12. The shield connector 1 according to the first modified example of the second embodiment differs from the shield connector 1 according to the second embodiment only in that the auxiliary concave portion 52 is formed by knurls.

The other configuration is the same as that of the second embodiment, and thus the redundant description is omitted. The same reference numerals are assigned to the same structural portions in the drawings for clarification.

In the first modified example, a cross-sectional view in a state where the shield member 10 is arranged on the substrate 30 and a cross-sectional view in a state where the shield member 10 is soldered are drawings substantially similar to those in FIGS. 10A, 10B, 11A, and 11B of the second embodiment.

As described with reference to FIGS. 10A, 10B, 11A, and 11B, also in the first modified example of the second embodiment, the reference surface 22, the stepped surface 23 (first stepped surface 23*a* and second stepped surface 23*b*), and the stepped side surface 23*c* formed by the step formed by these surfaces serve as bonded surfaces of the solder 41 for soldering.

Thus, the solder bonding area is increased as compared with the case where the substrate mounting surface 51 is a flat surface, so that the bonding strength of the shield connector 1 to the substrate 30 is improved.

Figure 13:
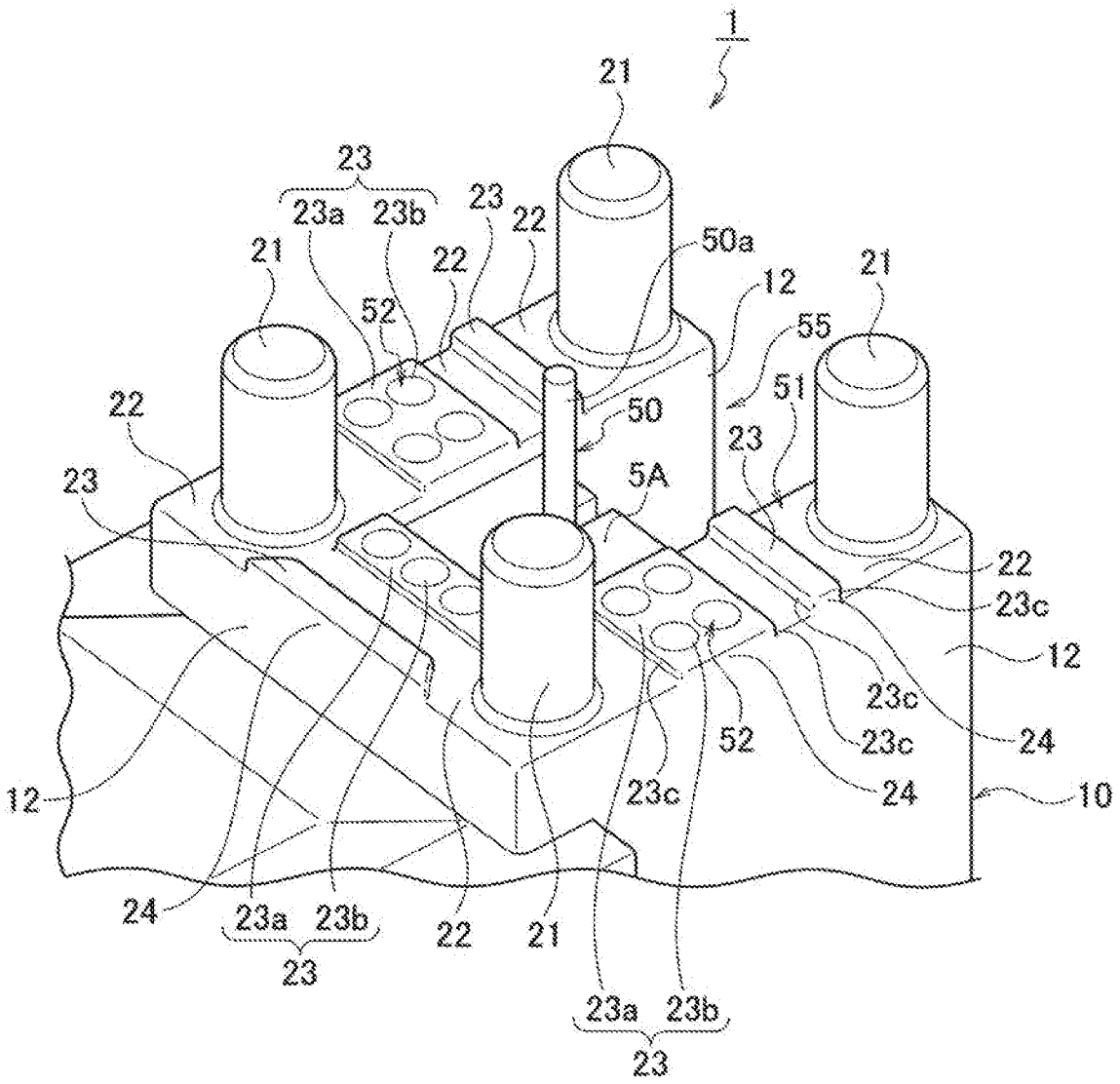
FIG. 13 is a perspective view of a main portion of a shield member according to a second modified example of the second embodiment, viewed from the bottom surface side.

The shield connector 1 according to a second modified example of the second embodiment is illustrated in FIG. 13. The shield connector 1 according to the second modified example of the second embodiment differs from the shield connector 1 according to the second embodiment only in that the auxiliary concave portion 52 is formed by a hemispherical groove.

The substrate mounting surface 51 is composed of a reference surface 22 which is the most concave (low), a first stepped surface 23*a* which is formed by the convex portion 24 and is the most protruding (high), and a second stepped surface 23*b* which is formed by the auxiliary concave portion 52 and has an intermediate height. The second stepped surface 23*b* is formed of a hemispherical groove and thus has a height which is not constant but gradually changes.

The other configuration is the same as that of the second embodiment, and thus the redundant description is omitted. The same reference numerals are assigned to the same structural portions in the drawings for clarification.

In the second modified example of the second embodiment, the reference surface 22, the stepped surface 23 (first stepped surface 23*a* and second stepped surface 23*b*), and the stepped side surface 23*c* formed by the step formed by these surfaces serve as bonded surfaces of the solder 41 for soldering.

Thus, the solder bonding area is increased as compared with the case where the substrate mounting surface 51 is a flat surface, so that the bonding strength of the shield connector 1 to the substrate 30 is improved.

In the first embodiment, on the substrate mounting surface 20 of the wall portions 12 at both end positions, the stepped surface 23 is formed by the convex portion 24 protruding from the reference surface 22 of the substrate mounting surface 20. On the substrate mounting surface 26 of the wall portion 13 at the intermediate position of the shield member 10, the stepped surface 23 is formed by a concave portion 27 recessed from the reference surface 22 of the substrate mounting surface 51.

The stepped surface 23 of the modified example is considered to be formed by both the convex portion and the concave portion. In other words, the stepped surface 23 may be formed by at least one of the convex portion 24 protruding from the reference surface 22 of the substrate mounting surface 20 and the concave portion 27 recessed from the reference surface 22 of the substrate mounting surface 20.

In the first embodiment, the second stepped surface 23*b* is formed by providing the auxiliary convex portion 25 in the convex portion 24. In the second embodiment, the second stepped surface 23*b* is formed by providing the auxiliary concave portion 52 in the convex portion 24.

A modified example is considered that the second stepped surface and the third stepped surface are formed by providing both the auxiliary convex portion and the auxiliary concave portion in the convex portion 24.

A modified example is considered that a concave portion is formed by providing an auxiliary convex portion, a concave portion is formed by providing an auxiliary concave portion, or a concave portion is formed by providing both an auxiliary convex portion and an auxiliary concave portion.

In the first and second embodiments, the stepped surface 23 has two surfaces which are the first stepped surface 23*a* and the second stepped surface 23*b*, but may have three or more surfaces.

In the first and second embodiments, the reference surface 22 includes but not limited to the widest gap d3 with respect to the surface of the substrate 30. The reference surface 22 may be a surface having the smallest gap dimension with respect to the surface of the substrate 30 or a surface having an intermediate gap dimension with respect to the surface of the substrate 30.

The present embodiment is not limited to these examples, and various modifications can be made within the scope of the gist of the present embodiment.

A comparative example will then be described. A shield connector 100 according to a first comparative example includes a terminal 101, an inner housing 102, an inner shield member 103, an outer housing 104, and an outer shield member 105.

The inner housing 102 holds the terminal 101. The inner shield member 103 covers the outer periphery of the inner housing 102. The outer, shield member 105 covers the outer periphery of the outer housing 104. The inner shield member 103 and the outer shield member 105 are brought into contact with each other by an elastic contact piece 106 of the outer shield member 105.

A first leg portion 110 is provided at the lower portion of the inner shield member 103. Second to fourth leg portions 111 are provided at the lower portion of the outer shield member 105. The first leg portion 110 to the fourth leg portion 111 are inserted into through-holes of a substrate. The first leg portion 110 to the fourth leg portion 111 are soldered to the substrate. Thus, soldering the first leg portion 110 to the fourth leg portion 111 while being inserted into the through-holes allows the shield connector 100 to be mounted on the substrate.

A shield connector 100 according to a second comparative example is a coaxial connector. The shield connector 100 includes a center terminal 130, an insulator housing 131 for holding the center terminal 130, and a shield member 132 as an outer conductor covering the outer periphery of the housing 131.

A plurality of leg portions 133 is provided at the lower portion of the shield member 132. A plurality of leg portions 133 is inserted into holes of a substrate 120 and fixed.

Thus, the shield connector 100 is mounted on the substrate 120 by inserting the plurality of leg portions 133 into the holes of the substrate 120.

However, the shield connector 100 according to the first comparative example has a configuration in which the first leg portion 110 to the fourth leg portion 111 are soldered while being inserted into the through-holes.

Therefore, a solder crack may occur by an external force acting on the outer shield member 105, for example, and the bonding strength of the shield connector 100 to the substrate 120 is concerned.

The shield connector 100 according to the second comparative example has a configuration in which a plurality of leg portions 133 is inserted into holes of the substrate 120 and fixed.

Therefore, the shield member 132 is likely to be displaced with respect to the substrate 120 by an external force acting on the shield member 132, and the bonding strength of the shield connector 100 to the substrate 120 is concerned.

While certain embodiments have been described, these embodiments have been presented by way of example only, and are not intended to limit the scope of the inventions. Indeed, the novel embodiments described herein may be embodied in a variety of other forms; furthermore, various omissions, substitutions and changes in the form of the embodiments described herein may be made without departing from the spirit of the inventions. The accompanying claims and their equivalents are intended to cover such forms or modifications as would fall within the scope and spirit of the inventions.

What is claimed is:

1. A shield connector comprising:

a shield member for covering an outer periphery of a terminal; and a substrate mounting surface provided on the shield member and fixed to a surface of a substrate via solder, wherein the substrate mounting surface has a reference surface and a stepped surface having a different height with respect to the reference surface creating a stepped side surface between the reference surface and the stepped surface and extending perpendicular thereto, the solder being bonded to the reference surface, the stepped surface and the stepped side surface, and wherein the shield member includes a terminal housing chamber configured to house an inner terminal and an outer terminal.

2. The shield member according to claim 1, wherein an upper surface of the terminal housing chamber of the shield member is formed in a rectangular planar shape.

3. The shield connector according to claim 1, wherein the stepped surface is formed by at least one of a convex portion protruding at a different height with respect to the reference surface of the substrate mounting surface and a concave portion recessed at a different height with respect to the reference surface of the substrate mounting surface.

4. The shield connector according to claim 3, wherein the convex portion or the concave portion is provided with an auxiliary convex portion protruding further than the convex portion or an auxiliary concave portion recessed further than the concave portion.

5. The shield connector according to claim 3, wherein the shield member has a wall portion protruding downward, a bottom surface of the wall portion comprises the substrate mounting surface, and the reference surface is formed in a central region of the substrate mounting surface, and the stepped surfaces are formed in both end regions of the substrate mounting surface by the concave portions.

6. The shield connector according to claim 3, wherein the substrate mounting surface is provided with a positioning pin to be inserted into a positioning pin insertion hole of the substrate, and a periphery of the positioning pin is formed into the most concave surface of the reference surface and the stepped surface.

7. The shield connector according to claim 1, further comprising chamber is configured as an electrically insulating housing.

8. The shield connector according to claim 7, wherein the electrically insulating housing is disposed on top of the shield member.

9. A shield connector comprising:

a shield member for covering an outer periphery of a terminal;

a substrate mounting surface provided on the shield member and fixed to a surface of a substrate via solder; and an electrically insulating housing, wherein the substrate mounting surface has a reference surface and a stepped surface having a different height with respect to the reference surface creating a stepped side surface between the reference surface and the stepped surface and extending perpendicular thereto, the solder being bonded to the reference surface, the stepped surface and the stepped side surface.

10. The shield connector according to claim 9, wherein the electrically insulating housing is disposed on top of the shield member.

11. The shield member according to claim 9, wherein an upper surface of the electrically insulating housing is formed in a rectangular planar shape.

12. The shield member according to claim 9, wherein the shield member includes a terminal housing chamber configured to house an inner terminal and an outer terminal.

13. The shield connector according to claim 9, wherein the stepped surface is formed by at least one of a convex portion protruding at a different height with respect to the reference surface of the substrate mounting surface and a concave portion recessed at a different height with respect to the reference surface of the substrate mounting surface.

14. The shield connector according to claim 13, wherein the convex portion or the concave portion is provided with an auxiliary convex portion protruding further than the convex portion or an auxiliary concave portion recessed further than the concave portion.

15. The shield connector according to claim 13, wherein the shield member has a wall portion protruding downward, a bottom surface of the wall portion comprises the substrate mounting surface, and the reference surface is formed in a central region of the substrate mounting surface, and the stepped surfaces are formed in both end regions of the substrate mounting surface by the concave portions.

16. The shield connector according to claim 13, wherein the substrate mounting surface is provided with a positioning pin to be inserted into a positioning pin insertion hole of the substrate, and a periphery of the positioning pin is formed into the most concave surface of the reference surface and the stepped surface.

* * * * *